US011692711B2

(12) United States Patent
Monaghan et al.

(10) Patent No.: US 11,692,711 B2
(45) Date of Patent: Jul. 4, 2023

(54) PILOT BURNER FOR COMBUSTOR

(71) Applicant: General Electric Company, Schenectady, NY (US)

(72) Inventors: Patrick Thomas Monaghan, Taylors, SC (US); Holger Matthias Luebcke, Loerrach (DE); Andre Theuer, Baden (CH); Nico Biagioli, Oberdorf (CH)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/401,468

(22) Filed: Aug. 13, 2021

(65) Prior Publication Data

US 2023/0046745 A1 Feb. 16, 2023

(51) Int. Cl.

| | |
|---|---|
| ***F23R 3/34*** | (2006.01) |
| ***F23R 3/28*** | (2006.01) |
| ***F23R 3/14*** | (2006.01) |

(52) U.S. Cl.

CPC ..... *F23R 3/343* (2013.01); *F23R 3/14* (2013.01); *F23R 3/286* (2013.01)

(58) Field of Classification Search

CPC .... F23R 3/14; F23R 3/28; F23R 3/283; F23R 3/286; F23R 3/343

See application file for complete search history.

(56) References Cited

U.S. PATENT DOCUMENTS

| | | | | |
|---|---|---|---|---|
| 8,069,671 | B2 | 12/2011 | Hellat et al. | |
| 9,074,764 | B2 | 7/2015 | Hull et al. | |
| 9,664,393 | B2 | 5/2017 | Andersson et al. | |
| 11,371,706 | B2 * | 6/2022 | Harper | F02C 3/30 |
| 2002/0189257 | A1 * | 12/2002 | Steinbach | F23R 3/343 60/737 |
| 2003/0150217 | A1 * | 8/2003 | Gutmark | F23D 11/402 60/725 |

(Continued)

FOREIGN PATENT DOCUMENTS

| | | | |
|---|---|---|---|
| EP | 2225488 | B1 | 7/2013 |
| WO | 2007113130 | A1 | 10/2007 |

OTHER PUBLICATIONS

Lorstad et al., "Siemens SGT-800 Industrial Gas Turbine Enhanced to 50MW: Combustor Design Modifications, Validation and Operation Experience," Proceedings of ASME Turbo Expo 2013: Turbine Technical Conference and Exposition, GT2013, Jun. 3-7, 2013, GT2013-95478.

*Primary Examiner* — William H Rodriguez
(74) *Attorney, Agent, or Firm* — James Pemrick; Charlotte Wilson; Hoffman Warnick LLC

(57) ABSTRACT

A pilot burner for a combustor includes an inner conduit configured to deliver a fuel, and an outer conduit concentric with the inner conduit and configured to deliver air. An inner wall defines an inner plenum, and a partition wall is radially outward of the inner wall and defines an intermediate plenum with at least a portion of the inner wall. Exit passages fluidly couple the inner plenum to the intermediate plenum. An outer wall defines an outer plenum with at least a portion of the partition wall. A crossover section includes passages fluidly coupling the inner conduit to the outer plenum, and passages fluidly coupling the outer conduit to the inner plenum. An end plate includes openings to direct fuel, air for combustion, and air for cooling from the respective plenums.

17 Claims, 8 Drawing Sheets

(56) References Cited

U.S. PATENT DOCUMENTS

| | | | | |
|---|---|---|---|---|
| 2010/0146983 | A1* | 6/2010 | Hellat | F23R 3/286 60/737 |
| 2010/0175382 | A1* | 7/2010 | Eroglu | F23R 3/286 60/748 |
| 2012/0247116 | A1* | 10/2012 | Meeuwissen | F23D 17/002 60/772 |
| 2014/0096502 | A1* | 4/2014 | Karlsson | F02C 7/12 60/746 |
| 2015/0253011 | A1 | 9/2015 | Uhm et al. | |
| 2017/0082290 | A1* | 3/2017 | Stewart | F23R 3/12 |
| 2017/0363294 | A1 | 12/2017 | Grooms et al. | |
| 2018/0231254 | A1 | 8/2018 | Maurer et al. | |
| 2018/0231255 | A1 | 8/2018 | Gaupp et al. | |
| 2019/0032559 | A1* | 1/2019 | Dai | F23R 3/343 |
| 2019/0271470 | A1 | 9/2019 | Boardman et al. | |
| 2019/0376691 | A1* | 12/2019 | Zajadatz | F23R 3/14 |

* cited by examiner

PILOT BURNER FOR COMBUSTOR

TECHNICAL FIELD

The disclosure relates generally to combustors and, more particularly, to a pilot burner for a combustor having a single fuel conduit and an air conduit.

BACKGROUND

Gas turbine systems are used in a wide variety of applications to generate power. In operation of a gas turbine system ("GT system"), air flows through a compressor, and the compressed air is supplied to a combustion section. Specifically, the compressed air is supplied to one or more combustors each having a number of fuel nozzles, i.e., burners, which use the air in a combustion process with a fuel. The compressor includes an array of inlet guide vanes (IGVs), the angle of which can be controlled to control an air flow to the combustion section, and thus a combustion temperature. The combustion section is in flow communication with a turbine section in which the combustion gas stream's kinetic and thermal energy is converted to mechanical rotational energy. The turbine section includes a turbine that rotatably couples to and drives a rotor. The compressor may also rotatably couple to the rotor. The rotor may drive a load, like an electric generator.

In some embodiments, the combustion section includes a number of combustors that can be used to control the load of the GT system, e.g., a plurality of circumferentially spaced combustor 'cans.' A header (or end cover) combustion stage may be positioned at an upstream end of the combustion region of each combustor. The header combustion stage includes a number of fuel nozzles or burners that act to introduce fuel for combustion in a combustion chamber defined by a respective liner.

In an annular combustion system, a plurality of burners is circumferentially arranged along a combustor dome upstream of a shared combustion chamber. Each burner includes a premix burner and a pilot burner. The premix burner includes a swirler that premixes fuel and air. The swirler includes a plurality of swirl vanes that impart rotation to the entering air and a plurality of fuel spokes that distribute fuel in the rotating air stream. The fuel and air then mix in an annular passage, referred to as a mixing tube, within the burner before reacting within a combustion zone in the combustion chamber.

A combustor must be able to address a range of operating conditions, such as applied load, combustion stability, combustion quality, firing temperature requirements, etc. Pilot burners are used to provide better control of the combustion process, for example, to provide improved combustion stability. For example, at low operating loads, the pilot burner may be operated to create fuel-rich zones ensuring the combustion flame does not extinguish. At higher operating loads, the pilot burner's fuel-air injection may be lowered to reduce pollutants. Pilot burners may be used in a variety of alternative settings to control the combustion process, also. In some instances, a pilot burner includes a lance extending longitudinally upstream of the mixing tube to inject a mixture including two fuels and air into the mixing tube. The structure to provide two fuels and air in a lance is complicated by the need to cool the pilot burner to address thermal expansion and contraction. In other instances, the pilot burner may introduce fuel and air radially near an end of the mixing tube, but this arrangement is not ideal for operational control of the combustion process.

BRIEF DESCRIPTION

All aspects, examples, and features mentioned below can be combined in any technically possible way.

An aspect of the disclosure provides a burner for a combustion chamber of a combustor, the burner comprising: a swirl generator defining a first portion of a burner interior; a mixing tube downstream of the swirl generator and defining a second portion of the burner interior, the mixing tube having an outlet opening in fluid communication with the combustion chamber; and a pilot lance extending along a longitudinal axis and extending into the burner interior, the pilot lance including a pilot burner having a single fuel conduit for supplying a fuel, and an air conduit for supplying air.

Another aspect of the disclosure includes any of the preceding aspects, and a longitudinal position of the pilot lance and the pilot burner downstream of a combustor end of the swirl generator is adjustable.

Another aspect of the disclosure includes any of the preceding aspects, and the single fuel conduit includes an inner conduit for supplying the fuel, and the air conduit as an outer conduit concentric with the inner conduit for supplying air, and wherein the pilot burner further includes: an inner wall defining an inner plenum; a partition wall radially outward of the inner wall and defining an intermediate plenum with at least a portion of the inner wall, the inner wall including a plurality of exit passages for fluidly coupling the inner plenum to the intermediate plenum; an outer wall defining an outer plenum with at least a portion of the partition wall; a crossover section including a first plurality of passages fluidly coupling the inner conduit to the outer plenum and a second plurality of passages fluidly coupling the outer conduit to the inner plenum; and an end plate including a plurality of openings in fluid communication with the burner interior, the plurality of openings including a set of fuel exit openings in fluid communication with the outer plenum, a set of air exit openings adjacent the set of fuel exit openings and in fluid communication with the intermediate plenum, and a set of cooling openings in fluid communication with the inner plenum.

Another aspect of the disclosure includes any of the preceding aspects, and further comprising a throat section in the outer plenum, the throat section constricting flow of fuel through the outer plenum.

Another aspect of the disclosure includes any of the preceding aspects, and the throat section includes a radially outward protrusion on the partition wall and an opposing, radially inward protrusion on the outer wall, the radially outward protrusion and the radially inward protrusion defining a throat passage having a first cross-sectional area, and wherein the partition wall and the outer wall define a plenum passage upstream and downstream of the protrusions having a second cross-sectional area that is greater than the first cross-sectional area.

Another aspect of the disclosure includes any of the preceding aspects, and the outer wall is radially flexible, and the crossover section and the end plate are less flexible than the outer wall.

An aspect of the disclosure provides a pilot burner for a combustor, the pilot burner comprising: an inner conduit configured to deliver a fuel; an outer conduit concentric with the inner conduit and configured to deliver air; an inner wall defining an inner plenum; a partition wall radially outward of the inner wall and defining an intermediate plenum with at least a portion of the inner wall, the inner wall including a plurality of exit passages for fluidly coupling the inner plenum to the intermedia plenum; an outer wall defining an outer plenum with at least a portion of the partition wall; a crossover section in fluid communication with the inner and outer conduit, the crossover section including a first plurality of passages fluidly coupling the inner conduit to the outer plenum and a second plurality of passages fluidly coupling the outer conduit to the inner plenum; and an end plate including a plurality of openings in fluid communication with a burner interior, the plurality of openings including a set of fuel exit openings in fluid communication with the outer plenum, a set of air exit openings adjacent the set of fuel exit openings and in fluid communication with the intermediate plenum, and a set of cooling openings in fluid communication with the inner plenum.

Another aspect of the disclosure includes any of the preceding aspects, and further comprising a throat section in the outer plenum, the throat section constricting flow of fuel through the outer plenum.

Another aspect of the disclosure includes any of the preceding aspects, and the throat section includes a radially outward protrusion on the partition wall and an opposing, radially inward protrusion on the outer wall, the radially outward protrusion and the radially inward protrusion defining a throat passage having a first cross-sectional area, and wherein the partition wall and the outer wall define a plenum passage upstream and downstream of the protrusions having a second cross-sectional area that is greater than the first cross-sectional area.

Another aspect of the disclosure includes any of the preceding aspects, and the outer wall is radially flexible, and the crossover section and the end plate are less flexible than the outer wall.

Another aspect of the disclosure includes any of the preceding aspects, and the inner conduit is coupled to an elongated fuel conduit of a pilot lance, and the outer conduit is coupled to elongated air conduit of the pilot lance.

An aspect of the disclosure provides a gas turbine (GT) system, comprising: a compressor; a combustion section operatively coupled to the compressor and including an annular combustor, the annular combustor including a burner for a combustion chamber of the annular combustor, the burner including: a hood; a swirl generator operatively coupled to the hood and defining a first portion of a burner interior; a mixing tube downstream of the swirl generator and defining a second portion of the burner interior, the mixing tube having an outlet opening in fluid communication with the combustion chamber; and a pilot lance extending along a longitudinal axis and extending from the hood into the burner interior, the pilot lance including a pilot burner having a single fuel conduit for supplying a fuel, and an air conduit for supplying air; and a turbine operatively coupled to the combustion section.

Another aspect of the disclosure includes any of the preceding aspects, and a longitudinal position of the pilot lance and the pilot burner downstream of a combustor end of the swirl generator is adjustable.

Another aspect of the disclosure includes any of the preceding aspects, and the single fuel conduit includes an inner conduit for supplying the fuel, and the air conduit as an outer conduit concentric with the inner conduit for supplying air, and wherein the pilot burner further includes: an inner wall defining an inner plenum; a partition wall radially outward of the inner wall and defining an intermediate plenum with at least a portion of the inner wall, the inner wall including a plurality of exit passages for fluidly coupling the inner plenum to the intermediate plenum; an outer wall defining an outer plenum with at least a portion of the partition wall; a crossover section including a first plurality of passages fluidly coupling the inner conduit to the outer plenum and a second plurality of passages fluidly coupling the outer conduit to the inner plenum; and an end plate including a plurality of openings in fluid communication with the burner interior, the plurality of openings including a set of fuel exit openings in fluid communication with the outer plenum, a set of air exit openings adjacent the set of fuel exit openings and in fluid communication with the intermediate plenum, and a set of cooling openings in fluid communication with the inner plenum.

Another aspect of the disclosure includes any of the preceding aspects, and further comprising a throat section in the outer plenum, the throat section constricting flow of fuel through the outer plenum.

Another aspect of the disclosure includes any of the preceding aspects, and the throat section includes a radially outward protrusion on the partition wall and an opposing, radially inward protrusion on the outer wall, the radially outward protrusion and the radially inward protrusion defining a throat passage having a first cross-sectional area, and wherein the partition wall and the outer wall define a plenum passage upstream and downstream of the protrusions having a second cross-sectional area that is greater than the first cross-sectional area.

Another aspect of the disclosure includes any of the preceding aspects, and the outer wall is radially flexible, and the crossover section and the end plate are less flexible than the outer wall.

Two or more aspects described in this disclosure, including those described in this summary section, may be combined to form implementations not specifically described herein.

The details of one or more implementations are set forth in the accompanying drawings and the description below. Other features, objects, and advantages will be apparent from the description and drawings and from the claims.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

Figure 1:
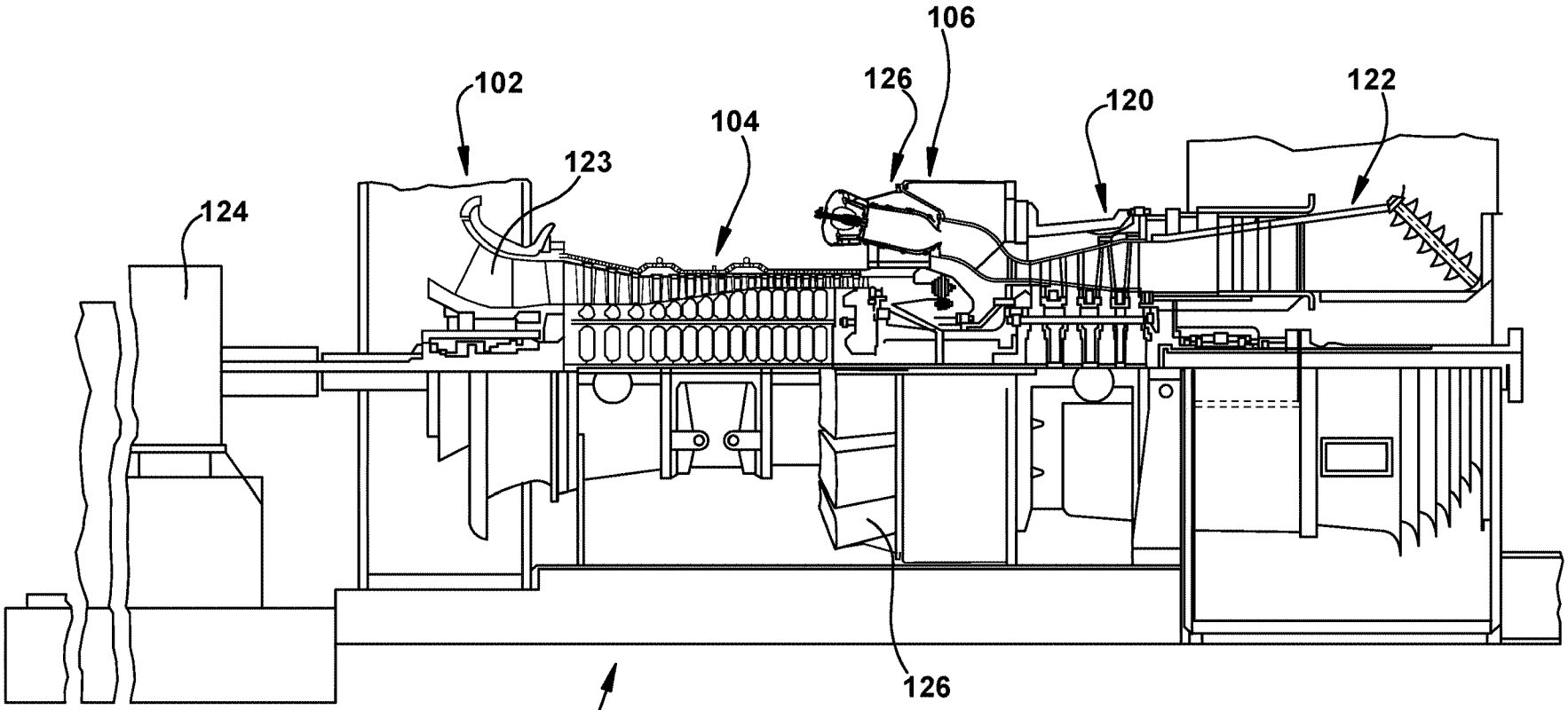
FIG. 1 shows a partial cross-sectional side view of a gas turbine (GT) system according to an embodiment of the disclosure.

It is noted that the drawings of the disclosure are not necessarily to scale. The drawings are intended to depict only typical aspects of the disclosure and therefore should not be considered as limiting the scope of the disclosure. In the drawings, like numbering represents like elements between the drawings.

DETAILED DESCRIPTION

As an initial matter, in order to clearly describe the subject matter of the current disclosure, it will become necessary to select certain terminology when referring to and describing relevant machine components within a gas turbine system or a combustor thereof. To the extent possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

In addition, several descriptive terms may be used regularly herein, and it should prove helpful to define these terms at the onset of this section. These terms and their definitions, unless stated otherwise, are as follows. As used herein, "downstream" and "upstream" are terms that indicate a direction relative to the flow of a fluid, such as the combustion gases in a combustor, the flow of air through the combustor, or coolant through one of the turbine's component systems. The term "downstream" corresponds to the direction of flow of the fluid, and the term "upstream" refers to the direction opposite to the flow (i.e., the direction from which the flow originates). The terms "forward" and "aft," without any further specificity, refer to directions, with "forward" referring to the front or compressor end of the engine, and "aft" referring to the rearward section of the turbomachine.

It is often required to describe parts that are disposed at different radial positions with regard to a center axis. The term "radial" refers to movement or position perpendicular to an axis. For example, if a first component resides closer to the axis than a second component, it will be stated herein that the first component is "radially inward" or "inboard" of the second component. If, on the other hand, the first component resides further from the axis than the second component, it may be stated herein that the first component is "radially outward" or "outboard" of the second component. The term "axial" refers to movement or position parallel to an axis. Finally, the term "circumferential" refers to movement or position around an axis. It will be appreciated that such terms may be applied in relation to the center axis of the turbine.

In addition, several descriptive terms may be used regularly herein, as described below. The terms "first," "second," and "third" may be used interchangeably to distinguish one component from another and are not intended to signify location or importance of the individual components.

The terminology used herein is for describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components but do not preclude the presence or addition of one or more other features, integers, steps, operations, elements, components, and/or groups thereof. "Optional" or "optionally" means that the subsequently described event or circumstance may or may not occur or that the subsequently described component or element may or may not be present, and that the description includes instances where the event occurs or the component is present and instances where it does not or is not present.

Where an element or layer is referred to as being "on," "engaged to," "connected to," or "coupled to" another element or layer, it may be directly on, engaged to, connected to, or coupled to the other element or layer, or intervening elements or layers may be present. In contrast, when an element is referred to as being "directly on," "directly engaged to," "directly connected to," or "directly coupled to" another element or layer, there are no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

As indicated above, the disclosure provides a burner and, in particular, a pilot burner for a combustor. The pilot burner includes an inner conduit for delivering a fuel, and an outer conduit concentric with the inner conduit for delivering air. An inner wall defines an inner plenum, and a partition wall radially outward of the inner wall defines an intermediate plenum with at least a portion of the inner wall. The inner wall includes a plurality of exit passages for fluidly coupling the inner plenum to the intermediate plenum. An outer wall defines an outer plenum with at least a portion of the partition wall. A crossover section is in fluid communication with the inner and outer conduit. The crossover section includes a first plurality of passages fluidly coupling the inner conduit to the outer plenum and a second plurality of passages fluidly coupling the outer conduit to the inner plenum. An end plate includes a plurality of openings in fluid communication with a burner interior. The plurality of openings includes a set of fuel exit openings in fluid communication with the outer plenum, a set of air exit openings adjacent the set of fuel exit openings and in fluid communication with the intermediate plenum, and a set of cooling openings for the end plate in fluid communication with the inner plenum. The pilot burner can be used with a single fuel and air and can be selectively positioned within a burner interior to provide, inter alia, improved combustion stability, quality and firing temperature control.

FIG. 1 shows a cross-sectional view of an illustrative gas turbine system application for a burner according to embodiments of the description. As will be recognized, a burner as described herein has a number of alternative applications, such as but not limited to: jet engines, blast furnaces, etc. In FIG. 1, gas turbine (GT) system 100 includes an intake section 102 and a compressor 104 downstream from intake section 102. Compressor 104 feeds air to a combustion section 106 that is coupled to a turbine section 120. Compressor 104 may include one or more stages of inlet guide vanes (IGVs) 123. As understood in the art, the angle of stages of IGVs 123 can be adjusted dynamically to control an air flow volume to combustion section 106 and thus parameters such as the combustion temperature of section 106. Combustion section 106 includes an annular combustor 126. Exhaust from turbine section 120 exits via an exhaust section 122. Turbine section 120 drives compressor 104 and a load 124 through a common shaft or rotor connection. Load 124 may be any one of an electrical generator and a mechanical drive application and may be located forward of intake section 102 (as shown) or aft of exhaust section 122. Examples of such mechanical drive applications include an electric generator, a compressor for use in oil fields, and/or a compressor for use in refrigeration. When used in oil fields, the application may be a gas reinjection service. When used in refrigeration, the application may be in liquid natural gas (LNG) plants. Yet another load 124 may be a propeller as may be found in turbojet engines, turbofan engines and turboprop engines.

Figure 2:
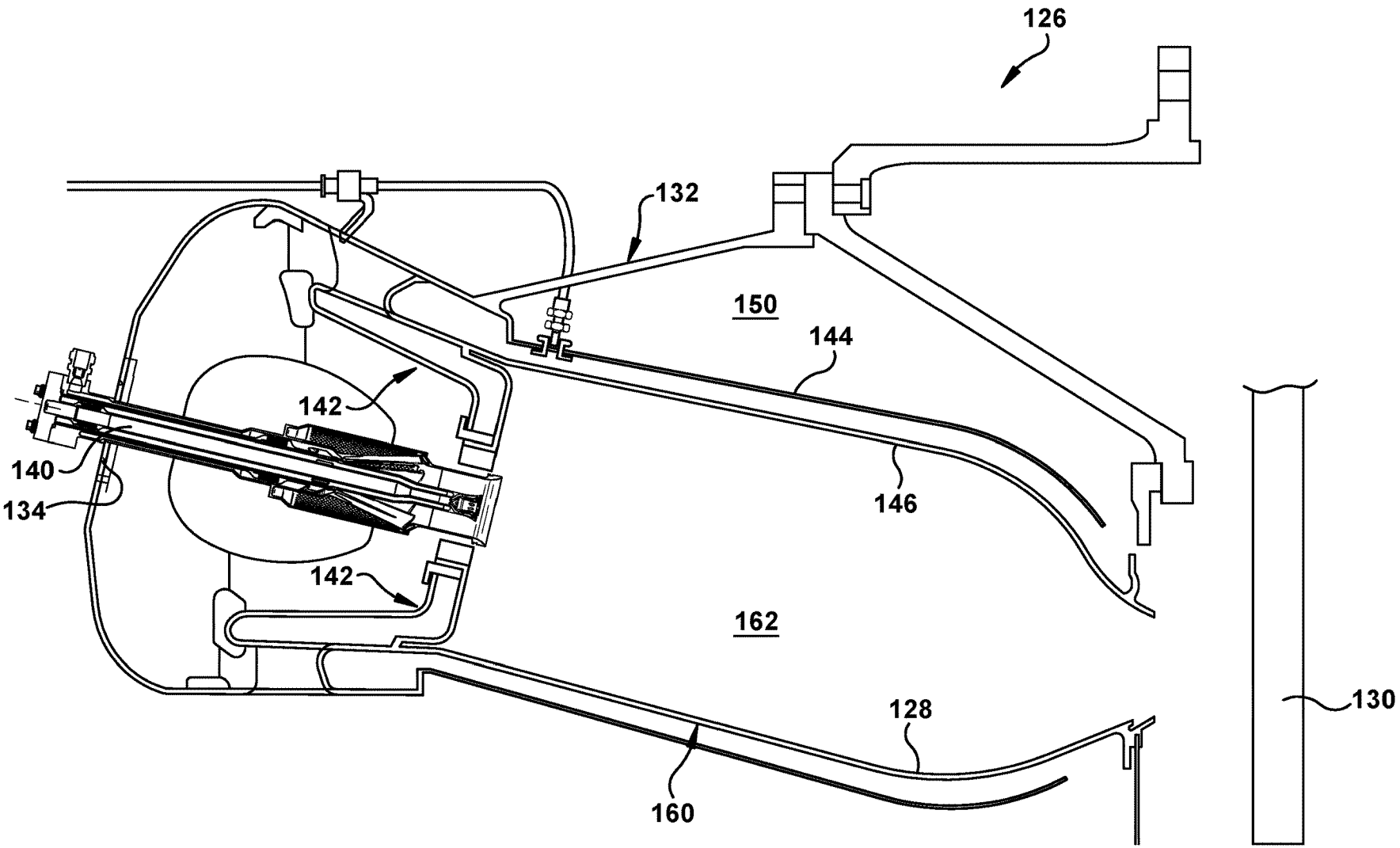
FIG. 2 shows a partial cross-sectional side view of an annular combustor for a combustion section useable in the GT system of FIG. 1.

Referring to FIGS. 1 and 2, combustion section 106 may include annular combustor 126, or a circular array of a plurality of circumferentially spaced combustors. FIG. 2 shows a partial cross-sectional side view of an illustrative annular combustor 126. A fuel/air mixture is burned in combustor 126 to produce the hot energetic combustion gas flow, which flows through the downstream end of combustor 126 to turbine nozzles 130 of turbine section 120 (FIG. 1). For purposes of the present description, only a portion of combustor 126 is illustrated, it being appreciated that the annular combustor 126 is symmetrical about the longitudinal axis of GT system 100. It is contemplated that the present disclosure may be used in conjunction with other combustor systems, including and not limited to can annular combustor systems.

Referring now to FIG. 2, there is shown generally a portion of combustor 126 for GT system 100 (FIG. 1) including a combustion or reaction zone 160. An inner liner 128 and an outer liner 146 collectively define a combustion plenum 162 through which hot combustion gas flows to turbine nozzles 130 and the turbine blades (not shown). Combustor 126 may include a casing 132 (mounting cone), a hood 134 (or end cover) to which burners 140 are mounted, a plurality of burners 140, a front panel 142 (or cap assembly), and an outer sleeve 144 surrounding one or both of inner liner 128 and outer liner 146 of combustion plenum 162. An ignition device(s) (not shown) is/are provided and may include an electrically energized spark plug.

Combustion in combustion zone 160 occurs between inner liner 128 and outer liner 146. Combustion air is directed within combustion plenum 162 defined by combustion liners 128, 146 via sleeve 144 and may enter combustion liner 128, 146 through burners 140 and, optionally, through a plurality of openings formed in front panel 142. The air enters combustion liner 128, 146 under a pressure differential and mixes with fuel from start-up burners (not shown) and/or plurality of burners 140 disposed circumferentially around front panel 142. Consequently, a combustion reaction occurs within combustion zone 160 releasing heat for the purpose of driving turbine section 120 (FIG. 1). High-pressure air for combustion zone 160 may enter outer sleeve 144 from an annular plenum 150 defined by casing 132. Compressor 104 (FIG. 1) supplies high-pressure air for this purpose and other applications relative to burners 140.

Figure 3:
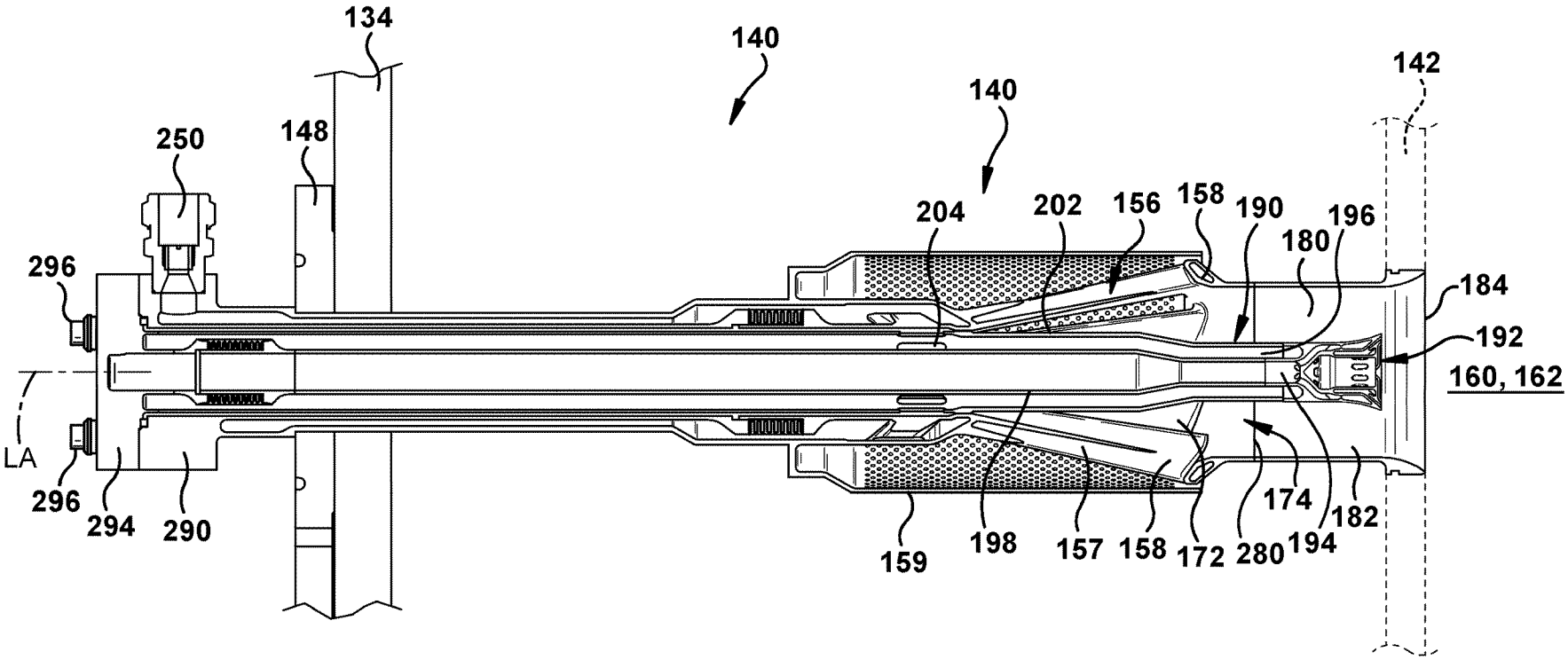
FIG. 3 shows a cross-sectional view of a burner including a pilot lance and pilot burner, according to embodiments of the disclosure.

FIG. 3 shows a cross-sectional view of a burner 140 for combustion chamber 162 of combustor 126, in accordance with embodiments of the disclosure. Burner 140 may be coupled to hood 134, e.g., using a mounting flange 148. Hood 134 and mounting flange 148 may include any structural element for mounting and/or positioning one or more burners 140. Mounting flange 148 may position each burner 140 for fuel and/or air supply conduit coupling, electrical connections and any other operability features, any of which may occur outside hood 134.

Burner 140 also includes a swirl generator 156 axially spaced from and operatively coupled to hood 134. Swirl generator 156 defines a first portion 172 of a burner interior 174. Swirl generator 156 may include any now known or later developed structure for mixing an oxidizer (e.g., air) and a fuel (e.g., liquid or gaseous fuel) into a swirling gaseous flow in burner interior 174. For example, swirl generator 156 may include a plurality of swirl vanes 157 that impart rotation to the entering air and a plurality of fuel spokes 158 that distribute fuel in the rotating air stream. The fuel and air then mix in an annular passage, referred to as a mixing tube 180, within burner 140 before reacting within combustion zone 160 of combustion chamber 162. An inlet flow conditioner (IFC) sleeve 159 may surround swirl generator 156. In many cases, swirl generator has a frusto-conical shape that enlarges as it progresses towards combustion chamber 162.

Burner 140 also includes mixing tube 180 downstream of swirl generator 156, such that mixing tube 180 defines a second portion 182 of burner interior 174. Mixing tube 180 has an outlet opening 184 in fluid communication with combustion zone 160 of combustion chamber 162. Outlet opening 184 may be in, or part of, front panel 142, which may position a number of burners 140 relative to a common combustion chamber 162.

Figure 4:
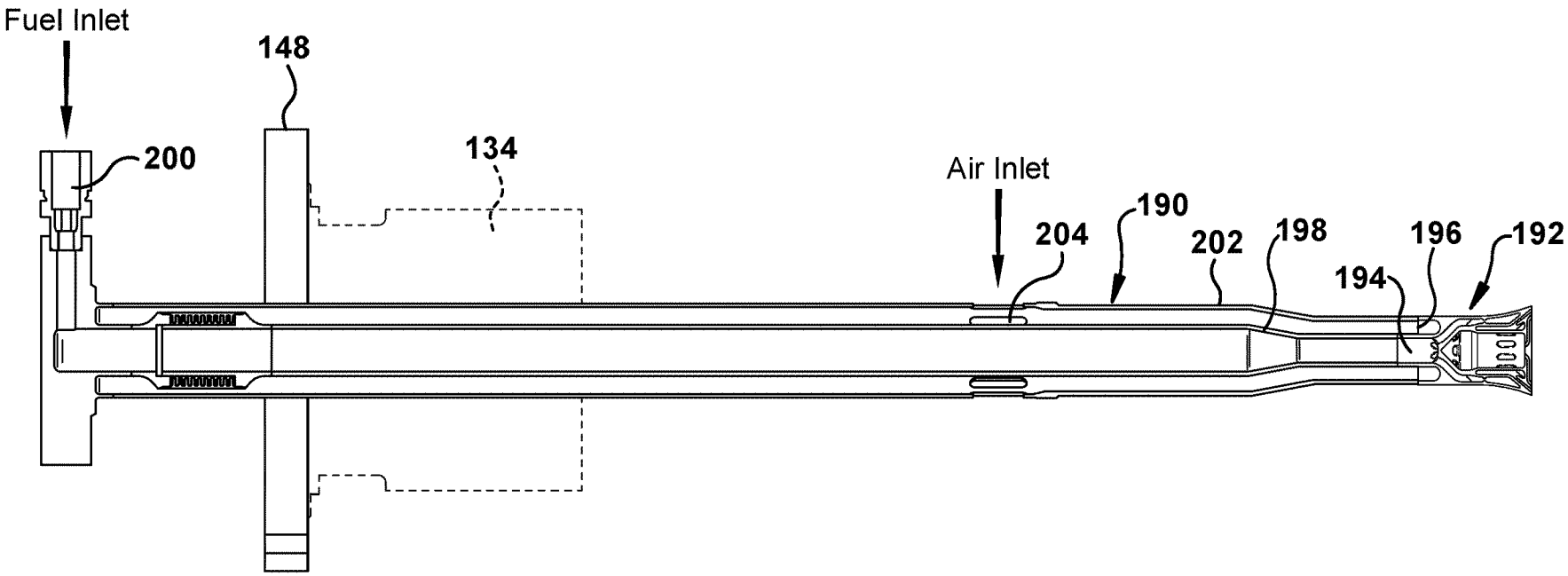
FIG. 4 shows a cross-sectional view of a pilot lance and pilot burner, according to embodiments of the disclosure.

As shown in FIG. 3 and in the cross-sectional view of FIG. 4, burner 140 also includes a pilot lance 190 extending along a longitudinal axis LA of burner 140 and extending from hood 134 into burner interior 174. Pilot lance 190 includes a pilot burner 192 including a single fuel conduit 194 for supplying a fuel, which is surrounded by an air conduit 196 for supplying air. Single fuel conduit 194 of pilot burner 192 couples to an elongated fuel conduit 198 of pilot lance 190 and extending through hood 134 to couple to a fuel supply line 200. The fuel can be liquid, e.g., oil, or gas, e.g., natural gas. Air conduit 196 of pilot burner 192 couples to an elongated air conduit 202 of pilot lance 190, which extends concentrically for at least part of the length of elongated fuel conduit 198.

Elongated air conduit 202 may include one or more inlets 204 through which high pressure air may enter. As noted, high-pressure air for combustion zone 160 may enter outer sleeve 144 (FIG. 2) from an annular plenum 150. Compressor 104 (FIG. 1) supplies this high-pressure air to plenum 150 (FIG. 2) of casing 132. The high pressure air may also be routed in a wide variety of ways from hood 134 to elongated air conduit 202. Pilot lance 190 includes only single fuel conduit 194, i.e., no more than one fuel is supplied by pilot lance 190.

Figure 5:
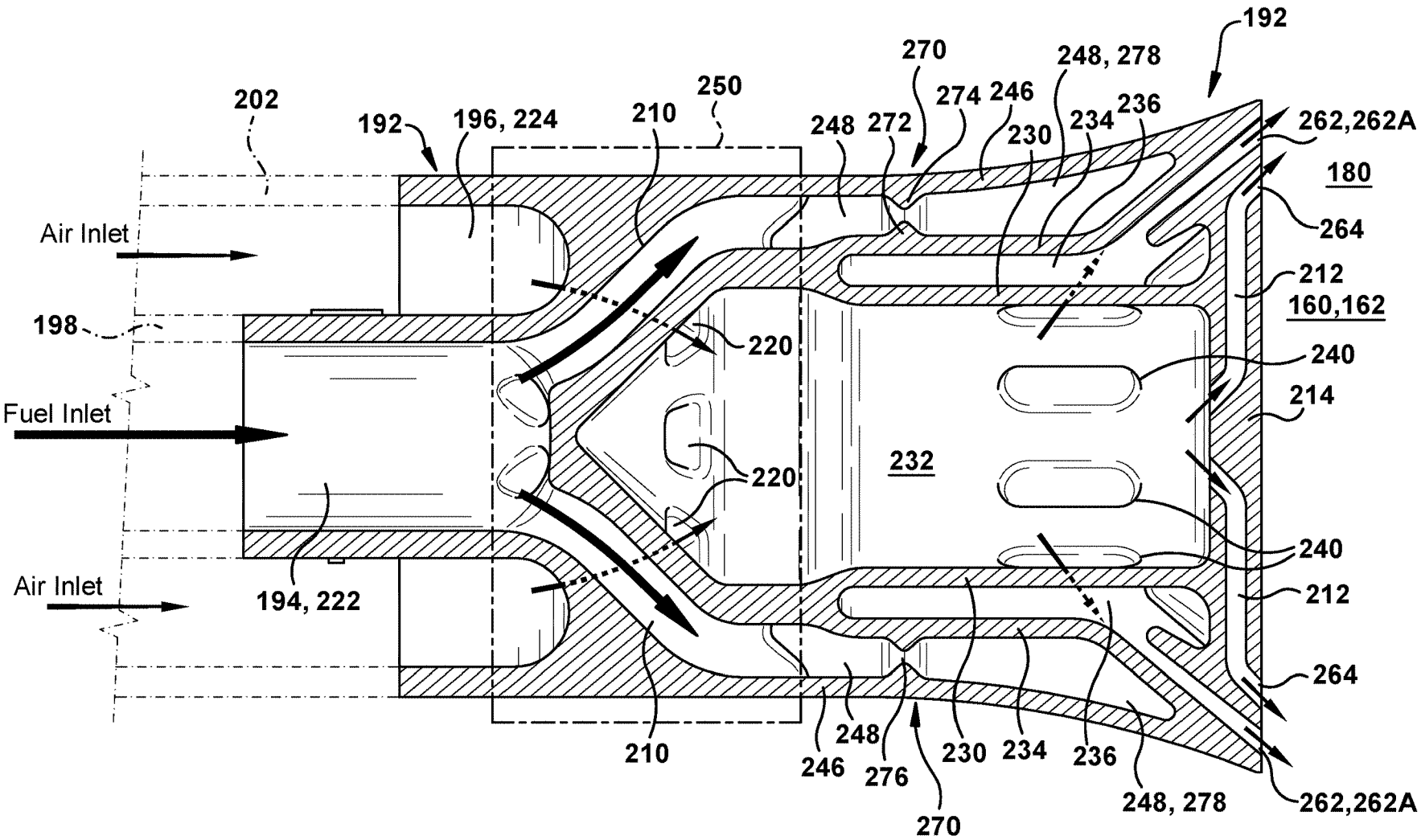
FIG. 5 shows an enlarged cross-sectional view of a pilot burner, according to embodiments of the disclosure.
Figure 6:
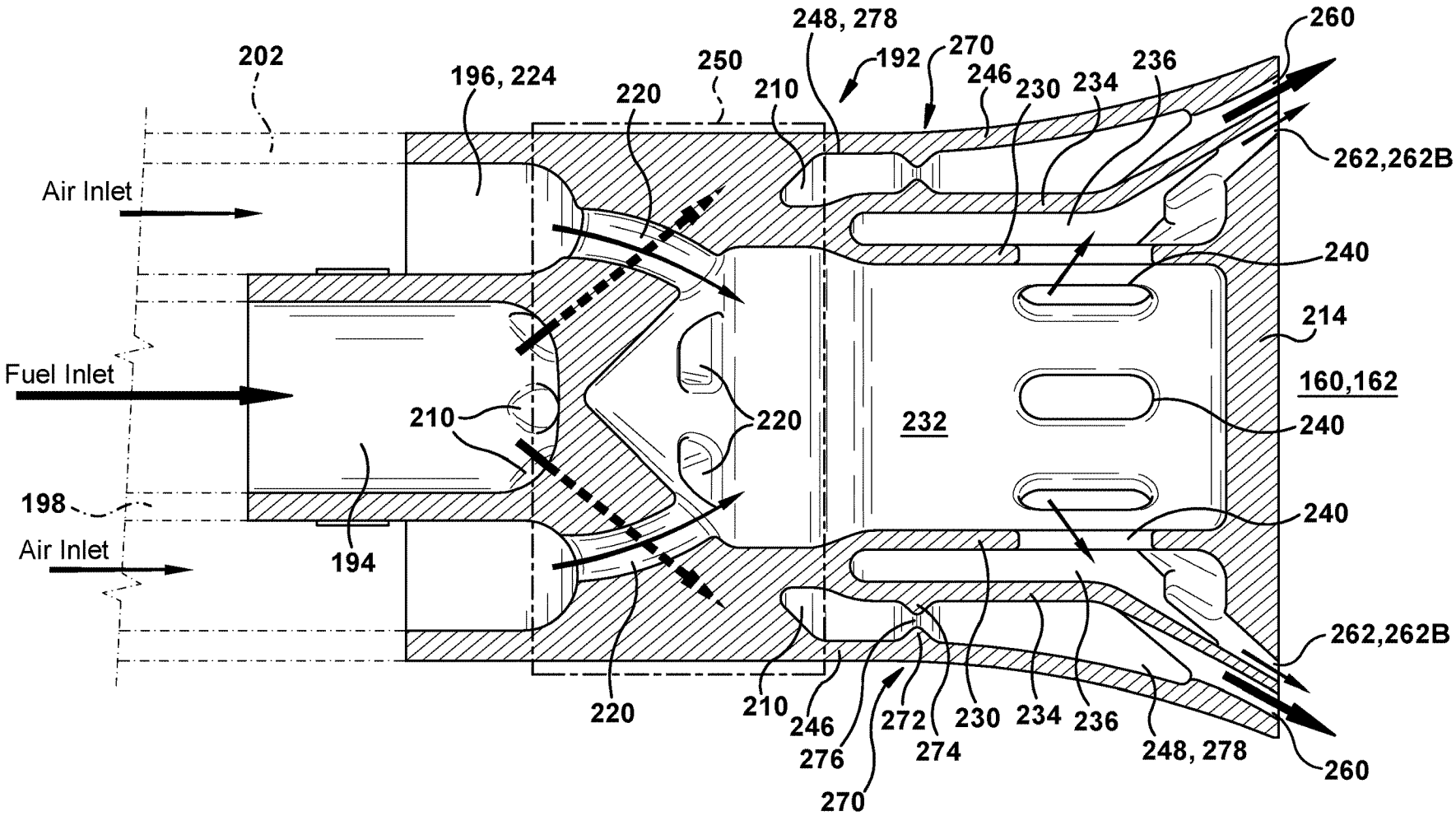
FIG. 6 shows another enlarged cross-sectional view of the pilot burner, according to embodiments of the disclosure.

FIGS. 5 and 6 show two cross-sectional views of pilot burner 192. As will be described in more detail, FIG. 5 shows a cross-sectional view through: a) a plurality of passages 210 allowing crossover of fuel from an inner position to an outer position, and b) a plurality of cooling passages 212 in an end plate or heat shield 214 of pilot burner 192. In contrast, FIG. 6 shows a cross-sectional view through: a) a plurality of passages 220 allowing crossover of air from an outer position to an inner position, and b) end plate 214 of pilot burner 192 where cooling passages 212 (FIGS. 5 and 7) are not existent. In FIGS. 5 and 6, arrows for showing the flow of fluids, i.e., fuel and air, are shown in dashed lines where the passage in which the fluid is flowing is at least partially hidden and perhaps entirely hidden, and the arrows are in solid lines where the passage is visible. Air is shown with thinner lined arrows, and fuel is shown with thicker lined arrows.

In pilot burner 192, single fuel conduit 194 includes an inner conduit 222 for supplying the fuel, and air conduit 196 includes an outer conduit 224 for supplying air. Outer conduit 224 may be concentric with inner conduit 222. Inner conduit 222 of pilot burner 192 is in fluid communication with elongated fuel conduit 198, and outer conduit 224 of pilot burner 192 is in fluid communication with elongated air conduit 202. The conduits can be physically coupled using any now known or later developed technique, e.g., welding, press fits, etc.

Pilot burner 192 includes an inner wall 230 defining an inner plenum 232. Pilot burner 192 may also include a partition wall 234 radially outward of inner wall 230 and defining an intermediate plenum 236 with at least a portion of inner wall 230. As shown best in FIG. 6, inner wall 230 includes a plurality of exit passages 240 for fluidly coupling inner plenum 232 to intermediate plenum 236. Any number of exit passages 240 may be provided. Pilot burner 192 also includes an outer wall 246 defining an outer plenum 248 with at least a portion of partition wall 234.

Pilot burner 192 includes a crossover section 250 (highlighted by a box in FIGS. 5 and 6). Crossover section 250 allows transition of fuel and air in a manner to allow cooling of pilot burner 192. Crossover section 250, which is in fluid communication with the inner and outer conduits 222, 224, includes passages 210 fluidly coupling inner (fuel) conduit 222 to outer plenum 248 and passages 220 fluidly coupling outer (air) conduit 224 to inner plenum 232. As best shown in FIG. 5, plurality of passages 210 fluidly couple inner conduit 222 (for fuel) to outer plenum 248. Passages 210 start in fluid communication with inner conduit 222 and terminate in fluid communication with outer plenum 248. Any number of passages 210 may be used. As best shown in FIG. 6, crossover section 250 also includes plurality of passages 220 fluidly coupling outer conduit 224 (air) to inner plenum 232. Passages 220 start in fluid communication with outer conduit 224 and terminate in fluid communication with inner plenum 232. Any number of passages 220 may be used. Crossover section 250 also couples the various walls 230, 234, 246 to the walls of conduits 222, 224.

Figure 7:
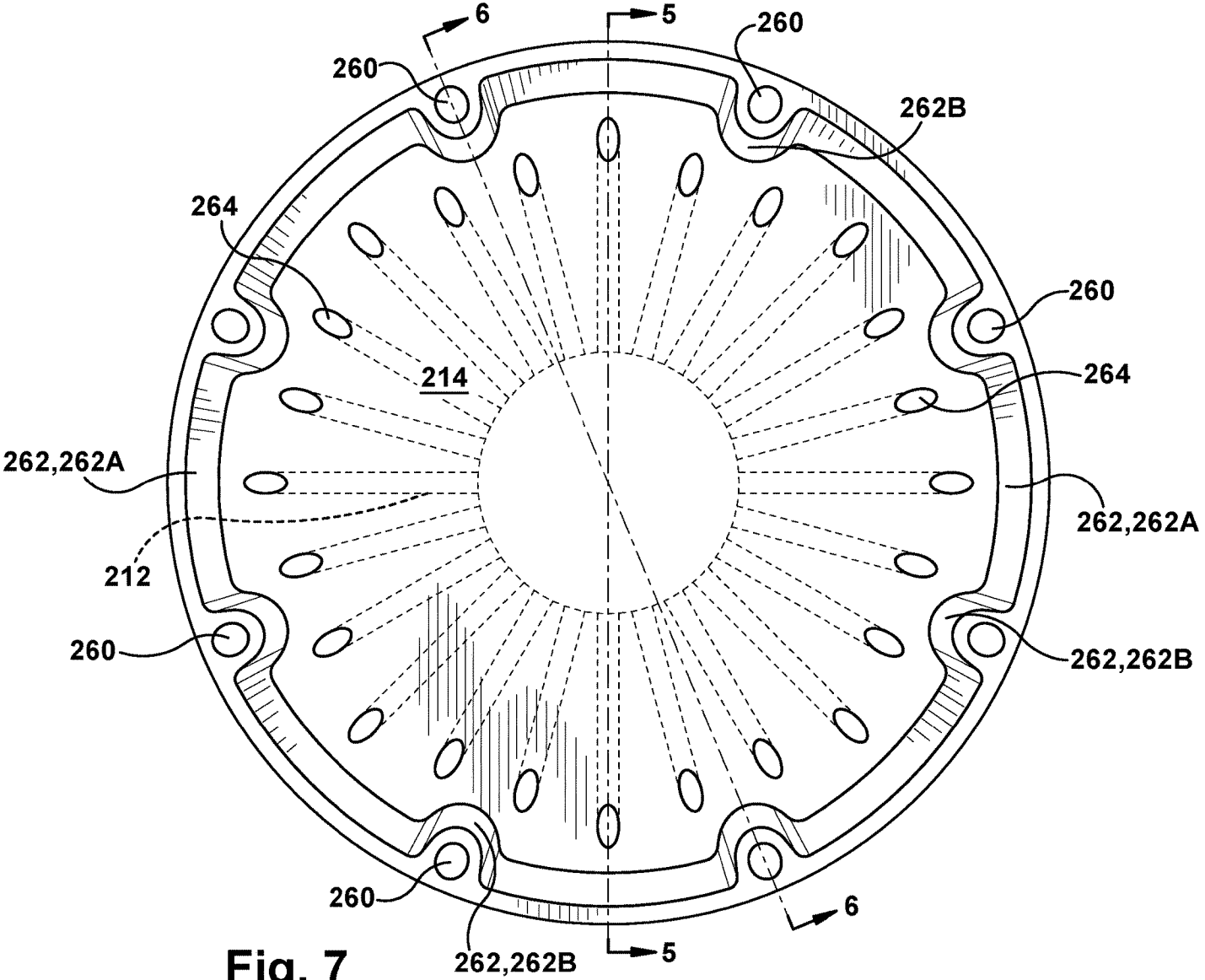
FIG. 7 shows an end view of an end plate of the pilot burner, according to embodiments of the disclosure.

Pilot burner 192 also includes an end plate 214, also sometimes referred to as a heat shield, including a plurality of openings in fluid communication with burner interior 174 (FIG. 3). FIG. 7 shows an end view of end plate 214. (FIG. 7 also shows the cross-sectional view lines 5-5 and 6-6 for FIGS. 5 and 6, respectively.) As shown in FIGS. 5-6, end plate 214 is a disc-like structure coupled to inner wall 230. End plate 214 is not coupled to partition wall 234 and outer wall 246. In this manner, end plate 214 allows for some relative motion of inner portions (e.g., inner wall 230 and interconnected structure) relative to the stiffer outer portions (e.g., partition wall 234, outer wall 246 and interconnected structure) that direct fuel through pilot burner 192.

End plate 214 acts as a terminus of pilot burner 192. End plate 214 includes plurality of openings therethrough to direct the fluids (fuel and air) into combustion zone 160. The openings may include a set of fuel exit openings 260 in fluid communication with outer plenum 248 (FIGS. 5 and 6), which holds fuel. The openings may also include a set of air exit openings 262 adjacent set of fuel exit openings 260 and in fluid communication with intermediate plenum 236 (FIGS. 5 and 6), which holds pressurized air. The openings may also include a set of cooling openings 264 in fluid communication with inner plenum 232, i.e., via cooling passages 212 (shown in FIG. 5 and by dashed lines in FIG. 7), which holds pressurized air. In this manner, fuel exits via fuel exit openings 260 and is mixed with air exiting air exit openings 262. Air also exits cooling openings 264 passing radially through end plate 214 to cool end plate 214.

As shown in FIG. 7, a set of air exit openings 262A may be adjacent fuel exit openings 260, and another set of air exit openings 262B may be radially outward of cooling openings 264. FIG. 7 shows how sets of air exit openings 262A, 262B may collectively form a generally circumferentially extending opening in pilot burner 192. The fuel and air pressures can be controlled by the sources of fuel (e.g., pump) and source of pressurized air (e.g., compressor bleed), and also by the size of openings 260, 262, 264. Any number of the openings 260, 262, 264 may be used to cool end plate 214 and create the desired fuel/air mixture for pilot combustion within mixing tube 180. In particular, any number of cooling passages 212 may be used within end plate 214.

In certain embodiments, as shown in FIGS. 5 and 6, outer plenum 248 may also include a throat section 270 to constrict flow of fuel through outer plenum 248. The restriction on flow of fuel in outer plenum 248 acts to smooth flow distribution from fuel exiting passages 210 into fuel exit openings 260. Throat section 270 may also result in increased cooling of crossover section 250. Accordingly, the stiffness of crossover section 250 can be greater than adjacent sections because it does not experience extensive thermal expansion and contraction. Throat section 270 may include a radially outward protrusion 272 on partition wall 234 and an opposing, radially inward protrusion 274 on outer wall 246. Radially outward protrusion 272 and radially inward protrusion 274 define a throat passage 276 having a first cross-sectional area. In contrast, partition wall 234 and outer wall 246 define a plenum passage 278 upstream and downstream of protrusions 272, 274 (that is, to both sides of protrusions 272, 274) having a second cross-sectional area that is greater than the first cross-sectional area. The sizing of first cross-sectional area thus creates a controllable restriction in flow of fuel through outer plenum 248 that can be employed to smooth flow distribution of air exiting passages 210 into fuel exit openings 260, and control cooling of, for example, crossover section 250.

Pilot burner 192 may be made of any metal or metal alloy appropriate for the environmental conditions in burner 140. As noted, crossover section 250 is relatively inflexible compared to adjacent sections. More particularly, outer wall 246 may be radially flexible, whereas crossover section 250 and end plate 214 are less flexible than outer wall 246. In at least one embodiment, pilot burner 192 may be produced using additive manufacturing techniques and equipment (such as direct metal laser sintering or direct metal laser melting), which facilitates the formation of various intricate features within pilot burner 192.

Figure 8:
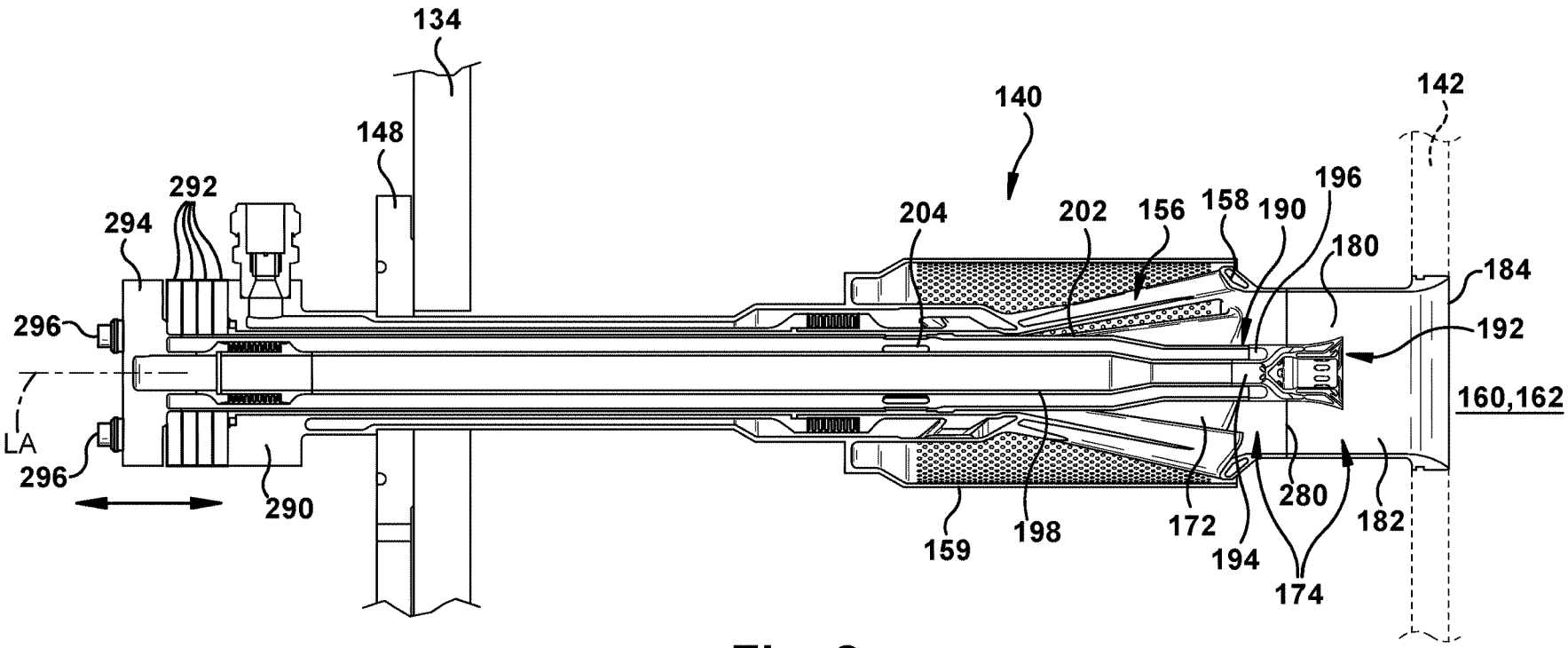
FIG. 8 shows a cross-sectional view of a burner including a pilot lance and pilot burner in an adjusted longitudinal position, according to embodiments of the disclosure.

Referring to FIGS. 3 and 8, pilot lance 190 and pilot burner 192 are positioned in an operative position downstream of a combustor end 280 of swirl generator 156 in burner interior 174. That is, pilot burner 192 is downstream of swirl generator 156. A longitudinal position of pilot burner 192 downstream of combustor end 280 of swirl generator 156 may be adjustable. More particularly, a longitudinal position of pilot lance 190 and pilot burner 192 can be user selected. Pilot lance 190 is coupled near hood 134, for example, to a stationary fuel input member 290 that couples fuel supply line 200 to elongated fuel conduit 198. In one non-limiting example, the longitudinal position of pilot lance 190 can be controlled by selecting a size and/or a number of spacer(s) 292 between a mount member 294 of pilot lance 190 and fuel input member 290 or other stationary structure near hood 134. The larger the collective dimensions of spacer(s) 292, the less pilot lance 190 extends into burner interior 174. Spacer(s) 292 include openings (not shown) through which fasteners 296, such as bolts, can fasten mount member 294 to, for example, fuel input member 290.

FIG. 3 shows an embodiment with no spacers 292. Consequently, pilot lance 190 is as far into burner interior 174 as possible with a given length of elongated fuel conduit 198 and elongated air conduit 202. FIG. 8 shows a number of spacers 292 positioning the same pilot lance 190 as in FIG. 3 farther upstream in burner interior 174. While a particular structure has been illustrated to allow different longitudinal positioning of pilot lance 190 and pilot burner 192, it will be recognized that a wide variety of alternative structures may be employed. In some instances, the extent of how far pilot burner 192 extends into burner interior 174 can be automated, e.g., using linear actuators under control of a burner controller. A length of elongated fuel conduit 198 and elongated air conduit 202 can also be user selected to control the positioning of pilot burner 192 in burner interior 174.

As described herein, embodiments of the disclosure provide a burner and a pilot burner for a combustor that uses a single fuel and air and that can be selectively positioned within a burner interior to provide, inter alia, improved combustion stability, quality and firing temperature control.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise. "Approximately," as applied to a particular value of a range, applies to both end values and, unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application and to enable others of ordinary skill in the art to understand the disclosure for various embodiments with various modifications as are suited to the particular use contemplated.

What is claimed is:

1. A burner for a combustion chamber of a combustor, the burner comprising:

a swirl generator defining a first portion of a burner interior;

a mixing tube downstream of the swirl generator and defining a second portion of the burner interior, the mixing tube having an outlet opening in fluid communication with the combustion chamber; and a pilot lance extending along a longitudinal axis and extending into the burner interior, the pilot lance including a pilot burner having a single fuel conduit for supplying a fuel, and an air conduit for supplying air, wherein the single fuel conduit includes an inner conduit for supplying the fuel, and the air conduit includes an outer conduit concentric with the inner conduit for supplying air, and wherein the pilot burner further includes:

an inner wall defining an inner plenum;

an outer wall defining an outer plenum; and a crossover section including a first plurality of passages fluidly coupling the inner conduit to the outer plenum and a second plurality of passages fluidly coupling the outer conduit to the inner plenum.

2. The burner of claim 1, wherein a longitudinal position of the pilot lance and the pilot burner downstream of a combustor end of the swirl generator is adjustable.

3. The burner of claim 1, wherein the pilot burner further includes:

a partition wall radially outward of the inner wall and defining an intermediate plenum with at least a portion of the inner wall, the inner wall including a plurality of exit passages for fluidly coupling the inner plenum to the intermediate plenum;

and an end plate including a plurality of openings in fluid communication with the burner interior, the plurality of openings including a set of fuel exit openings in fluid communication with the outer plenum, a set of air exit openings adjacent the set of fuel exit openings and in fluid communication with the intermediate plenum, and a set of cooling openings in fluid communication with the inner plenum.

4. The burner of claim 3, further comprising a throat section in the outer plenum, the throat section constricting flow of fuel through the outer plenum.

5. The burner of claim 4, wherein the throat section includes a radially outward protrusion on the partition wall and an opposing, radially inward protrusion on the outer wall, the radially outward protrusion and the radially inward protrusion defining a throat passage having a first cross-sectional area, and wherein the partition wall and the outer wall define a plenum passage upstream and downstream of the protrusions having a second cross-sectional area that is greater than the first cross-sectional area.

6. The burner of claim 3, wherein the outer wall is radially flexible, and the crossover section and the end plate are less flexible than the outer wall.

7. A pilot burner for a combustor, the pilot burner comprising:

an inner conduit configured to deliver a fuel;

an outer conduit concentric with the inner conduit and configured to deliver air;

an inner wall defining an inner plenum;

a partition wall radially outward of the inner wall and defining an intermediate plenum with at least a portion of the inner wall, the inner wall including a plurality of exit passages for fluidly coupling the inner plenum to the intermediate plenum;

an outer wall defining an outer plenum with at least a portion of the partition wall;

a crossover section in fluid communication with the inner and outer conduit, the crossover section including a first plurality of passages fluidly coupling the inner conduit to the outer plenum and a second plurality of passages fluidly coupling the outer conduit to the inner plenum; and an end plate including a plurality of openings in fluid communication with a burner interior, the plurality of openings including a set of fuel exit openings in fluid communication with the outer plenum, a set of air exit openings adjacent the set of fuel exit openings and in fluid communication with the intermediate plenum, and a set of cooling openings in fluid communication with the inner plenum.

8. The pilot burner of claim 7, further comprising a throat section in the outer plenum, the throat section constricting flow of fuel through the outer plenum.

9. The pilot burner of claim 8, wherein the throat section includes a radially outward protrusion on the partition wall and an opposing, radially inward protrusion on the outer wall, the radially outward protrusion and the radially inward protrusion defining a throat passage having a first cross-sectional area, and wherein the partition wall and the outer wall define a plenum passage upstream and downstream of the protrusions having a second cross-sectional area that is greater than the first cross-sectional area.

10. The pilot burner of claim 7, wherein the outer wall is radially flexible, and the crossover section and the end plate are less flexible than the outer wall.

11. The pilot burner of claim 7, wherein the inner conduit is coupled to an elongated fuel conduit of a pilot lance, and the outer conduit is coupled to elongated air conduit of the pilot lance.

12. A gas turbine (GT) system, comprising:

a compressor;

a combustion section operatively coupled to the compressor and including an annular combustor, the annular combustor including a burner for a combustion chamber of the annular combustor, the burner including:

a hood;

a swirl generator operatively coupled to the hood and defining a first portion of a burner interior;

a mixing tube downstream of the swirl generator and defining a second portion of the burner interior, the mixing tube having an outlet opening in fluid communication with the combustion chamber; and a pilot lance extending along a longitudinal axis and extending from the hood into the burner interior, the pilot lance including a pilot burner having a single fuel conduit for supplying a fuel, and an air conduit for supplying air;

and a turbine operatively coupled to the combustion section, wherein the single fuel conduit includes an inner conduit for supplying the fuel, and the air conduit includes an outer conduit concentric with the inner conduit for supplying air, and wherein the pilot burner further includes:

an inner wall defining an inner plenum;

an outer wall defining an outer plenum; and a crossover section including a first plurality of passages fluidly coupling the inner conduit to the outer plenum and a second plurality of passages fluidly coupling the outer conduit to the inner plenum.

13. The GT system of claim 12, wherein a longitudinal position of the pilot lance and the pilot burner downstream of a combustor end of the swirl generator is adjustable.

14. The GT system of claim 12, wherein the pilot burner further includes:

a partition wall radially outward of the inner wall and defining an intermediate plenum with at least a portion of the inner wall, the inner wall including a plurality of exit passages for fluidly coupling the inner plenum to the intermediate plenum;

and an end plate including a plurality of openings in fluid communication with the burner interior, the plurality of openings including a set of fuel exit openings in fluid communication with the outer plenum, a set of air exit openings adjacent the set of fuel exit openings and in fluid communication with the intermediate plenum, and a set of cooling openings in fluid communication with the inner plenum.

15. The GT system claim 14, further comprising a throat section in the outer plenum, the throat section constricting flow of fuel through the outer plenum.

16. The GT system claim 15, wherein the throat section includes a radially outward protrusion on the partition wall and an opposing, radially inward protrusion on the outer wall, the radially outward protrusion and the radially inward protrusion defining a throat passage having a first cross-sectional area, and wherein the partition wall and the outer wall define a plenum passage upstream and downstream of the protrusions having a second cross-sectional area that is greater than the first cross-sectional area.

17. The GT system of claim 14, wherein the outer wall is radially flexible, and the crossover section and the end plate are less flexible than the outer wall.

* * * * *